US008657012B2

(12) United States Patent
Fenton et al.

(10) Patent No.: US 8,657,012 B2
(45) Date of Patent: Feb. 25, 2014

(54) EFFICIENT OPEN WATER RISER DEPLOYMENT

(75) Inventors: Stephen P. Fenton, Aberdeen (GB); Ian Calder, Aberdeen (GB); Stewart Christie, Aberdeen (GB); Robert Lee, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 263 days.

(21) Appl. No.: 12/917,111

(22) Filed: Nov. 1, 2010

(65) Prior Publication Data

US 2012/0103622 A1 May 3, 2012

(51) Int. Cl.
*E21B 17/01* (2006.01)

(52) U.S. Cl.
USPC ..... 166/345; 166/338; 166/350; 166/367; 166/85.1; 405/158; 405/224.2

(58) Field of Classification Search
USPC ..... 166/345, 338–340, 344, 350–352, 359, 166/360, 366, 367, 378–380, 77.1, 85.1; 405/158, 169, 170–173, 184.4, 405/224.2–224.4
See application file for complete search history.

(56) References Cited

U.S. PATENT DOCUMENTS

| | | | | | |
|---|---|---|---|---|---|
| 3,902,553 | A | * | 9/1975 | Jergins | 166/352 |
| 3,999,617 | A | * | 12/1976 | Ilfrey et al. | 175/7 |
| 4,099,560 | A | * | 7/1978 | Fischer et al. | 166/350 |
| 4,147,221 | A | * | 4/1979 | Ilfrey et al. | 175/7 |
| 4,234,047 | A | * | 11/1980 | Mott | 175/5 |
| 4,234,269 | A | * | 11/1980 | Person et al. | 405/224.2 |
| 4,351,027 | A | * | 9/1982 | Gay et al. | 701/116 |
| 4,511,287 | A | * | 4/1985 | Horton | 405/204 |
| 4,547,163 | A | * | 10/1985 | Langpaap et al. | 441/2 |
| 4,624,318 | A | * | 11/1986 | Aagaard | 166/359 |
| 4,730,677 | A | * | 3/1988 | Pearce et al. | 166/345 |
| 4,913,238 | A | * | 4/1990 | Danazcko et al. | 405/223.1 |
| 5,046,896 | A | * | 9/1991 | Cole | 405/195.1 |
| 5,213,162 | A | * | 5/1993 | Iato | 166/341 |
| 5,657,823 | A | * | 8/1997 | Kogure et al. | 166/340 |
| 5,676,209 | A | * | 10/1997 | Reynolds | 166/345 |
| 5,941,310 | A | | 8/1999 | Cunningham et al. | |
| 6,042,303 | A | * | 3/2000 | Head | 405/195.1 |
| 6,227,300 | B1 | * | 5/2001 | Cunningham et al. | 166/339 |

(Continued)

FOREIGN PATENT DOCUMENTS

| | | |
|---|---|---|
| EP | 1 659 257 B1 | 1/2010 |
| EP | 1 987 223 B1 | 7/2010 |

(Continued)

OTHER PUBLICATIONS

GB Search Report dated Nov. 24, 2011 from corresponding Application No. GB1118749.9.

*Primary Examiner* — Matthew Buck
(74) *Attorney, Agent, or Firm* — Bracewell & Giuliani LLP

(57) ABSTRACT

A riser for use in subsea operations that is parked subsea deployed as needed onto wellheads disposed proximate where the riser is parked. A base anchored into the seafloor provides a pedestal for parking the riser. The riser emits a beacon signal so it can be located when needed. When parked, the riser can be kept in a vertical orientation by a buoyancy module mounted on an upper portion of the riser. A workboat, or other vessel, attaches to the parked riser and positions it onto a designated wellhead. An extension connects the riser to platform or other vessel above the sea surface.

19 Claims, 3 Drawing Sheets

(56) References Cited

U.S. PATENT DOCUMENTS

| | | | | |
|---|---|---|---|---|
| 6,336,508 | B1 * | 1/2002 | Guinn | 166/339 |
| 6,352,114 | B1 * | 3/2002 | Toalson et al. | 166/343 |
| 6,367,551 | B1 | 4/2002 | Fenton | |
| 6,402,430 | B1 * | 6/2002 | Guesnon | 405/224.2 |
| 6,408,947 | B1 * | 6/2002 | Cunningham et al. | 166/339 |
| 6,715,554 | B1 * | 4/2004 | Cunningham et al. | 166/348 |
| 6,752,100 | B2 * | 6/2004 | Guinn et al. | 114/258 |
| 7,008,141 | B2 * | 3/2006 | Fitzgerald et al. | 405/224.2 |
| 7,063,157 | B2 * | 6/2006 | Bartlett | 166/339 |
| 7,134,498 | B2 * | 11/2006 | Hopper | 166/357 |
| 7,143,830 | B2 * | 12/2006 | Bartlett | 166/339 |
| 7,240,736 | B2 | 7/2007 | Fenton | |
| 7,458,425 | B2 * | 12/2008 | Millheim et al. | 166/355 |
| 7,503,391 | B2 * | 3/2009 | McCanna et al. | 166/343 |
| 7,934,560 | B2 * | 5/2011 | Roveri et al. | 166/345 |
| 8,047,297 | B2 * | 11/2011 | Millheim et al. | 166/367 |
| 8,202,023 | B2 * | 6/2012 | Millheim | 405/166 |
| 2009/0044950 | A1 * | 2/2009 | Boudreau | 166/350 |
| 2009/0129867 | A1 * | 5/2009 | Millheim | 405/166 |
| 2010/0172697 | A1 * | 7/2010 | Millheim | 405/166 |
| 2011/0011320 | A1 * | 1/2011 | Yemington | 114/122 |
| 2011/0209651 | A1 | 9/2011 | Yemington | |

FOREIGN PATENT DOCUMENTS

| | | | |
|---|---|---|---|
| WO | 0133028 | A2 | 5/2001 |
| WO | 2006/057646 | A2 | 6/2006 |
| WO | 2007/092051 | A1 | 8/2007 |
| WO | 2007/108823 | A1 | 9/2007 |
| WO | 2009/067532 | A1 | 5/2009 |
| WO | 2009/067539 | A1 | 5/2009 |
| WO | 2009/067596 | A1 | 5/2009 |
| WO | 2009/067619 | A1 | 5/2009 |
| WO | 2010079366 | A1 | 7/2010 |

* cited by examiner

EFFICIENT OPEN WATER RISER DEPLOYMENT

BACKGROUND OF THE INVENTION

1. Field of the Invention

This invention relates in general to production of oil and gas wells, and in particular to a device and method for deploying a riser subsea. More particularly, the present invention relates to parking a riser subsea and moving the riser to an adjacent wellhead for wellhead operations.

2. Description of Related Art

Subsea risers are tubular members extending from the sea surface to seafloor. One option when encasing a drill string during drilling a well subsea, a riser typically spans between a drilling rig to a subsea wellhead mounted on the seafloor. The riser usually remains coupled to the subsea wellhead until after the well is completed. Fluids produced from the well generally flow from the wellhead into a flow line that discharges into a manifold connected to flow lines from other wellheads. Fluids converging in the manifold are delivered to above the sea surface via a main flow line. Over time, a producing well typically undergoes maintenance or workover procedures that require a riser be reconnected to the wellhead, this is usually a smaller diameter that can act as a conduit for wellbore fluids during well testing or a conduit for tools and gauges etc during well workover operations, so that the well can be accessed from above the sea surface. During such maintenance procedures the riser can be connected to drilling rig or a surface vessel on its upper end. In either instance, the riser is redeployed from a storage site or manufacturing facility and transported to the wellhead being maintained, which is a time consuming and costly step.

SUMMARY OF THE INVENTION

Disclosed herein is an apparatus for and method of subsea operations. In an example a method of deploying a riser is disclosed that includes initially running the riser from a conventional vessel, mobile drilling rig, or other site. In an example embodiment, the riser incorporates buoyancy such it can be moved from a given location or well site to another well site or location. Also, the riser can be parked subsea for a period of time then moving and mounting the riser onto a wellhead. An upper end of the riser can then be coupled to a facility above sea surface and the wellhead can be accessed from above the sea surface through the riser. The method may optionally include providing a riser mount on the seafloor on which the riser is parked. In an alternative example, a riser section can be attached to the upper end of the riser. In another alternative embodiment, a beacon can be emitted from the parked riser so that the riser can be located subsea. Alternatively, the riser can be parked onto a subsea wellhead. An optional buoyancy module can be added on the riser for maintaining the riser in a substantially vertical orientation. The steps of moving the riser from a parking location to a wellhead can be repeated.

Yet further disclosed is a riser assembly that includes a riser mount set in the seafloor and spaced apart from a proximate wellbore. The riser assembly includes a riser section having a lower end selectively parked on the riser mount and selectively engagable with a subsea wellhead positioned on the wellbore. A riser extension can selectively connect between an upper end of the riser section and a vessel at sea level, so that when the riser section is engaged with the wellhead and the riser extension is connected to the riser section, the wellhead is accessible through the riser section and riser extension from the vessel. A beacon can be included on the riser section. Optionally, a buoyancy module can be provided on the riser section that has a chamber selectively containing a gas.

DETAILED DESCRIPTION OF THE INVENTION

Figure 1:
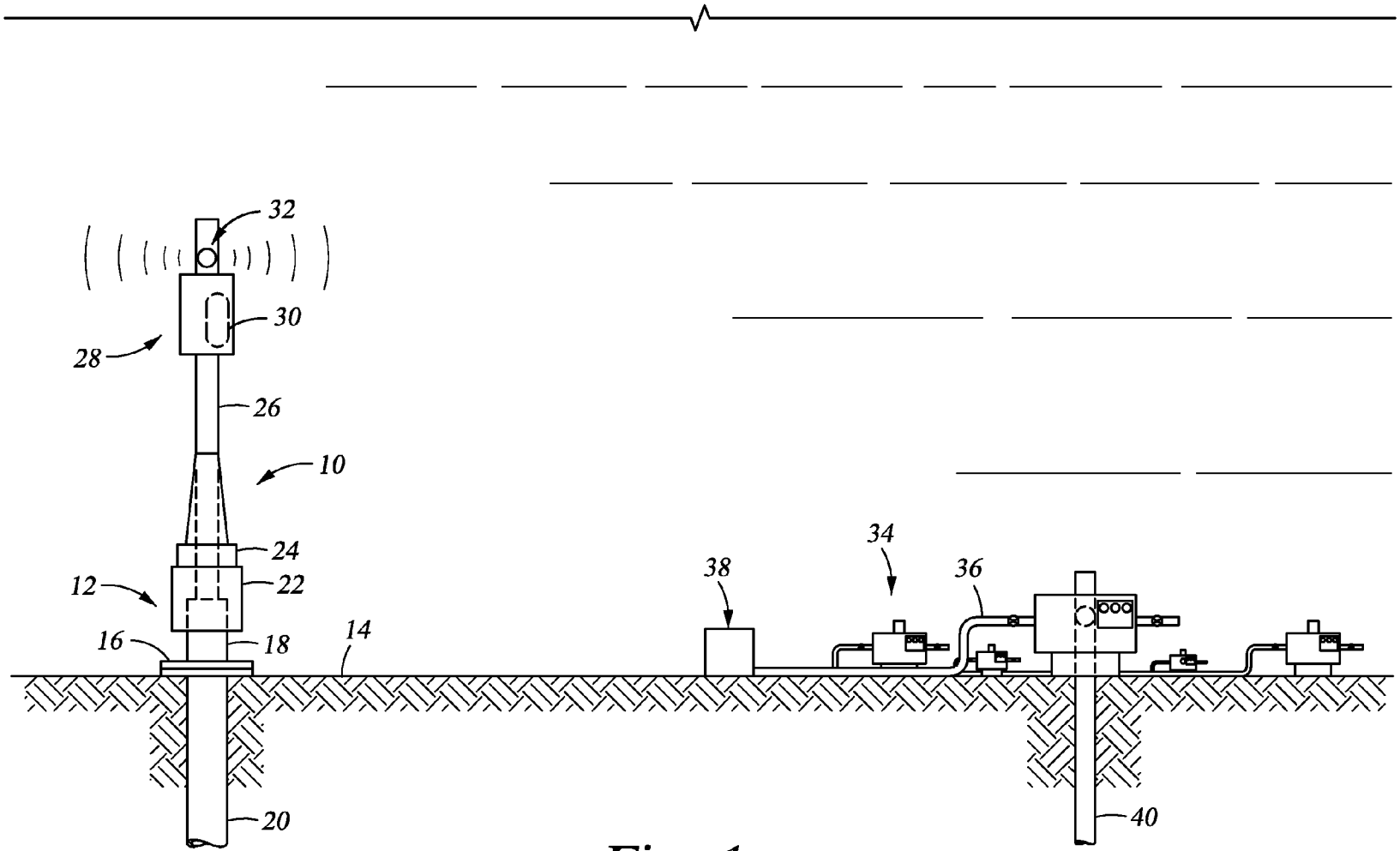
FIG. 1 is a side schematic view of an embodiment of a subsea exploration/production riser in accordance with the present disclosure.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring now to FIG. 1 an example embodiment of a portion of a riser assembly 10 is shown in a side view. The riser assembly 10 is shown parked on a riser mount 12 that anchors into the sea floor 14. In the embodiment of FIG. 1, the riser mount 12 is shown made up of a planar base 16 resting on the sea floor 14 and a substantially cylindrical pedestal 18 projecting upward from the base 16. In an optional embodiment, the pedestal 18 is profiled substantially similar to a mandrel typically found on an upper end of a wellhead assembly. An anchor pin 20 is shown in dashed outline that extends into the sea floor 14 for affixing the riser mount 12 in place and providing a stable support on which the riser assembly 10 may be parked. The sea floor 14 will dictate the design of the base 16 and anchor pin 20, and when the sea floor 14 is considered "soft", skirts (not shown) may be added for added support that extend from the base 16 and into the sea floor 14. In the example of FIG. 1, riser assembly 10 is made up primarily of a tubular assembly and is shown having a lower riser package 22 on its lower most end. Shown coaxially to and adjacent to the lower riser package 22 is an emergency disconnect package 24. An elongated tubular riser body 26 is shown mounted on an upper end of the emergency disconnect package (EDP) 24. Connectors may be included within the EDP 24 that secure the riser assembly 10 to the pedestal 18. Thus in one example use of the riser assembly 10, the riser mount 12 is set within the sea floor 14 specifically to provide a fixture on which the riser assembly 10 may be parked for a period of time before being deployed for use with wellbore operations. The riser assembly 10 can be configured so that its upper end is safely below the draft of ships and out of the way of seagoing vessels. In an example embodiment, the uppermost two or three riser joints of a typically sized riser could be removed to avoid ship traffic. In an alternate embodiment of the riser assembly 10 though, at least some of the riser assembly 10 can be above the sea surface.

A buoyancy module 28 is further shown provided with the riser assembly 10 on a portion of the riser body 26. The buoyancy module 28 is for maintaining the riser assembly 10 in a substantially vertical orientation while in the parked position, and may include substances having a density lower than sea water. In the example of FIG. 1, a chamber 30, shown in dashed outline, is provided within the buoyancy module 28. Alternatively, the buoyancy module 28 may contain multiple chambers 30 or be completely or partially filled with substances such as foam or constituents having densities less than sea water. While parked, care should be taken while "tuning" the buoyancy module 28 so that the upward force exerted by the buoyancy module 28 onto the riser assembly 10 is enough to maintain the riser assembly 10 vertical, while not pulling the riser mount 12 from the sea floor 14. So that the riser assembly 10 may be located while subsea and after having been parked for a period of time, a beacon 32 is shown that emits a signal or signals. The signals, in one example embodiment, may be a single continuous signal, or discreet signals that are used for locating the riser assembly 10.

Illustrated in FIG. 1 are wellhead assemblies 34 on the sea floor 14 and at a location proximate to the riser mount 12. Flow lines 36 attached to the wellhead assemblies 34 and are piped along the sea floor 14 to a manifold 38. Production fluid from wellbores 40 beneath the wellhead assemblies 34 is directed to production facilities through the flow lines 36 and manifold 38. Initial deployment of the riser assembly 10 may be from a drilling rig or other suitable vessel. Alternatively, initial deployment may be towed out by a lesser vessel of opportunity, in sections of nominally 150 to 300 m or more (with a suitable deployment frame and buoyant supports) and fully assembled in situ with ROV support from the same vessel that is also then used to effect intervention operations, without the need for instance a derrick, or handling tower.

Figure 2:
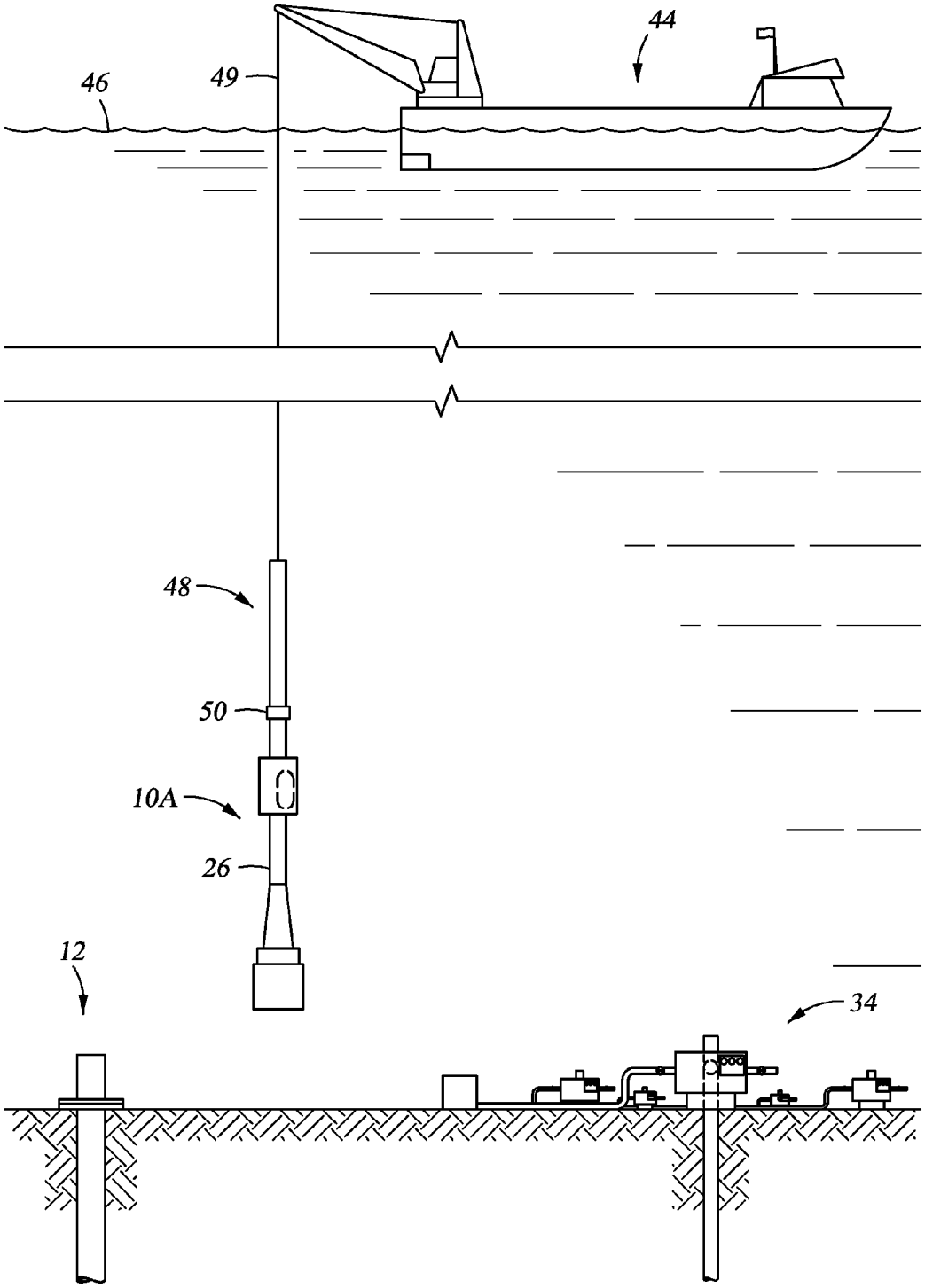
FIG. 2 is a side schematic view of the riser of FIG. 1 being moved from a parked to a deployed position.

Shown in FIG. 2, is an example of the work boat 44 at the sea surface 46 transporting riser assembly 10A from the riser mount 12 and towards one of the wellhead assemblies 34. In this example, a tubular riser section or extension 48 is attached to the upper end of the riser body 26 wherein, the riser extension 48 is suspended from a line 49 depending from the workboat 44. Optionally, the line 49 may depend from a vessel other than a workboat 44. In an alternative, the line 49 can attach directly to the upper end of the riser body 26. In the example of FIG. 2, a connection joint 50 provides connection between the riser body 26 and riser extension 48. In one example embodiment, the connection joint 50 is a riser tensioner joint. An example of a tensioner joint is described in Fraser, Jr., et al., U.S. Pat. No. 6,017,168, which is assigned to the assignee of the present application.

Figure 3:
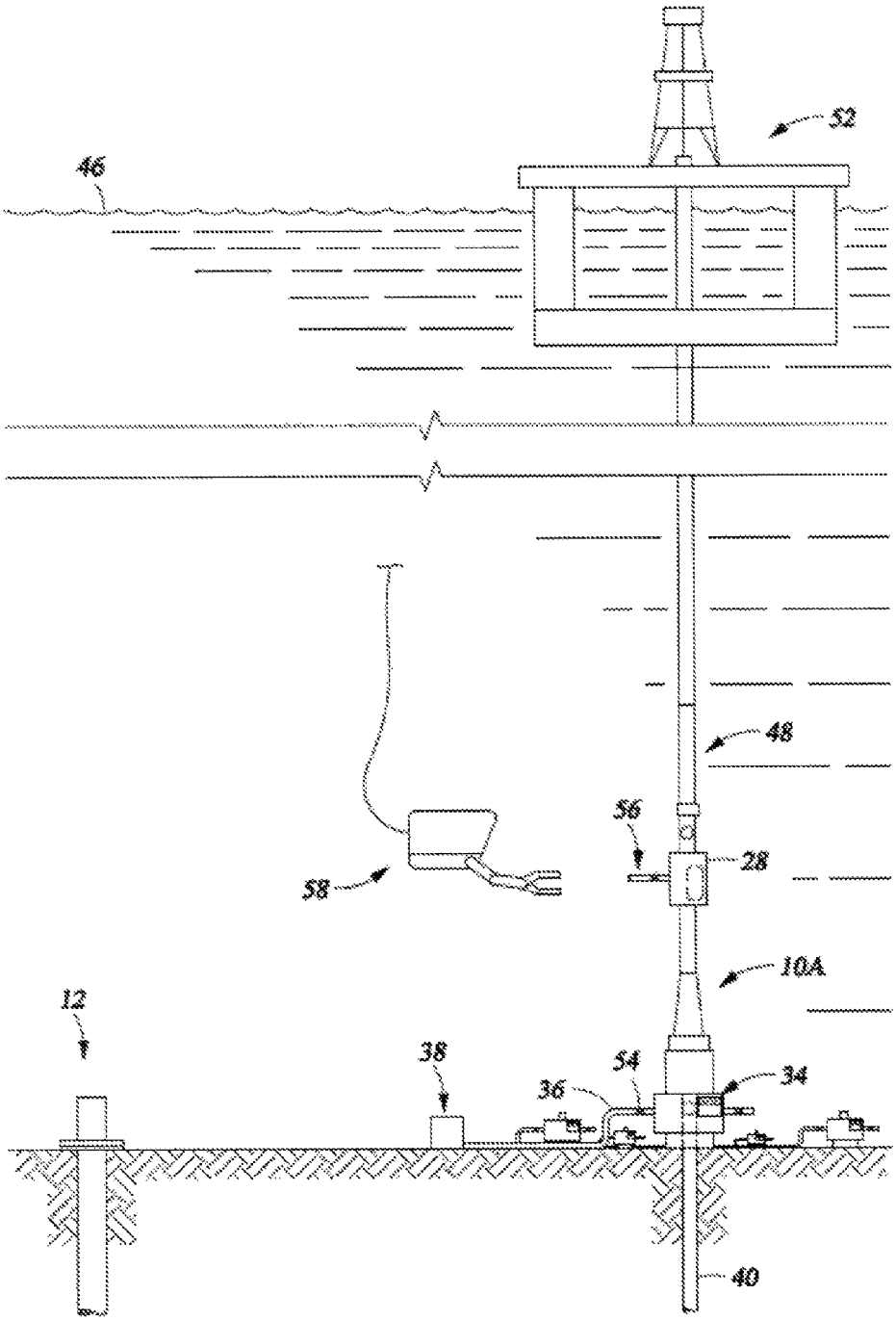
FIG. 3 is a side schematic view of an example embodiment of the riser of FIG. 2 in a deployed position.

Referring now to FIG. 3, the riser assembly 10A is shown having been attached to and deployed onto a wellhead assembly 34. The riser assembly 10A extends upward from the wellhead assembly 34 through the sea and attaches on its upper end to a platform 52 shown above the sea surface 46. The platform 52 can be any craft or vessel for conducting subsea operation such as a mobile drilling unit (MODU), intervention vessel, floating production facility, ship, and the like. As discussed above, the riser assembly 10 can be configured so it is a set distance beneath the sea surface and below the draft of passing ships. For such embodiments, the riser extension 48 would make up the difference in distance between the riser assembly 10 of FIG. 1 and the riser assembly 10A of FIG. 3. Also as discussed above, the distance from the upper end of the riser assembly 10 and sea surface can be roughly 100 feet, meaning the riser extension 48 can include about two to three riser joints.

A valve 54 is shown in a pipe extending from the wellhead assembly 34 into the flow line 36. When accessing the wellhead 34 and wellbore 40, the valve 54 may be closed, thereby isolating the flow line 36 and manifold 38 from wellbore operations. Also illustrated in FIG. 3 is a charging connection 56 for selectively providing gas or other substances to within the buoyancy module 28. In one example of use, a remotely operated vehicle (ROV) 58 is shown subsea that may be used to charge the buoyancy module 28 while it is beneath the sea surface 46. Charging the buoyancy module 28 may be required to tension the riser assembly 10A when it is mounted on the wellhead assembly 34. The recharging gas can be provided with the ROV 58, from a line (not shown) deployed from above the sea surface, or from a vessel (not shown) sent subsea with the ROV 58.

After completing operations through the riser assembly 10A between the platform 52 and wellhead assembly 34 and/or wellbore 40, the riser assembly 10A may be removed from the wellhead assembly 34. The riser assembly 10A can then be moved to another wellhead assembly or returned to the riser mount 12 as illustrated in FIG. 2. Upon or prior to being returned to the riser mount 12, the tubular riser extension 48 can optionally be removed from the riser assembly 10A. Either embodiment of the riser assembly 10, 10A may be parked for an indefinite period of time for retransportation and later use.

While the invention has been shown or described in only some of its forms, it should be apparent to those skilled in the art that it is not so limited, but is susceptible to various changes without departing from the scope of the invention.

What is claimed is:

1. A method of deploying a riser comprising:

a. parking a riser lower portion subsea for a period of time on a riser mount set in the seafloor and spaced proximate to a wellhead;

b. moving the riser lower portion from the parked position to the wellhead;

c. mounting a lower end of the riser lower portion onto the wellhead;

d. completing a full length of the riser by attaching a riser extension on an upper end of the riser lower portion;

e. coupling an upper end of the riser extension to a facility above sea surface;

f. accessing the wellhead from above the sea surface through the full length of the riser;

g. decoupling the riser extension from the facility;

h. detaching the riser extension from the riser lower portion;

i. returning the riser lower portion to the parked position;

j. emitting a beacon from the riser lower portion of step (a) so that the riser lower portion can be located subsea; and k. moving the riser lower portion from the parked position to a wellhead that is different from the wellhead of step (b).

2. The method of claim 1, wherein in step (a), the upper end of the riser lower portion is below the draft of a vessel sailing on the sea surface.

3. The method of claim 1, wherein the riser being parked in step (a) has a length less than a depth of the sea where the riser is parked.

4. The method of claim 3, wherein step (d) comprises further connecting a riser section to the upper end of the riser lower portion, the riser section having a length less than a length of the riser lower portion.

5. The method of claim 1, wherein the wellhead comprises a first wellhead, and the riser lower portion is parked on a second wellhead located subsea.

6. The method of claim 1, further comprising providing a buoyancy module on the riser lower portion for maintaining the riser in a substantially vertical orientation.

7. The method of claim 1, further comprising removing the riser lower portion from the wellhead and repeating steps (a)-(f).

8. The method of claim 1, wherein the riser mount comprises a pedestal that projects upward from the seafloor and is parked at a location proximate to the wellhead and a plurality of additional wellheads, and wherein a connector alone secures the riser lower portion to the pedestal.

9. A riser assembly comprising:

a riser mount set in the seafloor and spaced apart from a proximate wellbore;

a riser lower section having a lower end selectively parked on the riser mount and selectively engagable with a subsea wellhead positioned on the wellbore;

a connector on the lower end of the riser lower section that is in selective engagement with the riser mount to secure the riser lower section with the riser mount, and that is in selective engagement with the subsea wellhead positioned on the wellbore to secure the riser lower section to the subsea wellbore;

a beacon mounted on the riser lower section so that the riser lower section can be located subsea; and a riser extension selectively connected between an upper end of the riser lower section and a vessel at sea level, so that when the riser lower section is engaged with the wellhead and the riser extension is connected to the riser lower section, the wellhead is accessible through the riser lower section and the riser extension from the vessel.

10. The riser assembly of claim 9, further comprising a buoyancy module provided on the riser lower section that has a chamber selectively containing a gas.

11. The riser assembly of claim 10, further comprising a charging connection on the chamber for conveying gas into the chamber.

12. The riser assembly of claim 9, further comprising a riser tensioner joint on the upper end of the riser section that is where the riser extension connects to the riser section.

13. The riser assembly of claim 9, further comprising an emergency disconnect package and lower riser package provided on the riser lower section.

14. A method of deploying a riser comprising:

a. providing a riser having a lower end with an emergency disconnect package and a lower riser package;

b. parking the riser subsea for a period of time on a riser mount set in the seafloor and spaced proximate to a wellhead;

c. emitting a signal from a beacon on the parked riser;

d. locating the riser by using the signal from the beacon;

e. moving the riser from the parked position to the wellhead;

f. mounting the lower end of the riser onto the wellhead;

g. completing a full length of the riser by adding an extension to an upper end of the riser;

h. coupling an upper end of the riser to a facility above sea surface; and i. accessing the wellhead from above the sea surface through the full length of the riser.

15. The method of claim 14, further comprising providing a buoyancy module on the riser that comprises a chamber, a charging connection on the chamber for conveying gas into the chamber, the method further comprising charging the buoyancy module with gas.

16. The method of claim 15, the buoyancy module is charged after step (e).

17. The method of claim 14, further comprising providing a buoyancy module and wherein the extension is coupled above the buoyancy module.

18. The method of claim 14, further comprising hydraulically clamping the lower end of the riser to the riser mount.

19. The method of claim 14, wherein step (a) comprises towing sections of the riser along the sea surface and assembling the sections in situ with a remotely operated vehicle.

* * * * *